United States Patent [19]

Matsushita et al.

[11] 4,367,169

[45] Jan. 4, 1983

[54] α-OLEFIN SULFONATE-CONTAINING, LIQUID DETERGENT COMPOSITIONS HAVING IMPROVED LOW-TEMPERATURE STABILITY

[75] Inventors: Takao Matsushita, Koshigaya; Noriyuki Uchino, Tokyo, both of Japan

[73] Assignee: Lion Corporation, Tokyo, Japan

[21] Appl. No.: 313,815

[22] Filed: Oct. 22, 1981

[30] Foreign Application Priority Data

Oct. 27, 1980 [JP] Japan ..... 55-150293

[51] Int. Cl.[3] ..... C11D 1/14

[52] U.S. Cl. ..... 252/542; 252/536; 252/545; 252/555; 252/DIG. 14

[58] Field of Search ..... 252/536, 542, 545, 555, 252/106; 424/263

[56] References Cited

U.S. PATENT DOCUMENTS

| | | | |
|---|---|---|---|
| 3,852,221 | 12/1974 | Bentley | 252/548 |
| 4,107,095 | 8/1978 | Klisch et al. | 252/541 |
| 4,185,106 | 1/1980 | Dittmar et al. | 424/263 |
| 4,259,216 | 3/1981 | Miyajima et al. | 252/545 |
| 4,279,786 | 7/1981 | Sekiguchi et al. | 252/536 |
| 4,309,317 | 1/1982 | Sekiguchi et al. | 252/555 |

FOREIGN PATENT DOCUMENTS

| | | |
|---|---|---|
| 50-84605 | 7/1975 | Japan . |
| 1225218 | 3/1971 | United Kingdom . |

*Primary Examiner*—P. E. Willis, Jr.
*Attorney, Agent, or Firm*—Bacon & Thomas

[57] ABSTRACT

A liquid detergent composition having superior stability at low temperatures, which contains (a) an anionic surface active agent represented by the general formula:

OS—M (wherein OS is an acid residue of a straight-chained olefin sulfonate having an average carbon number of 10 to 16, and M is an alkali- or alkaline earth metal)

in an amount of 3 to 30% by weight of the composition weight; and (b) a compound represented by the general formula:

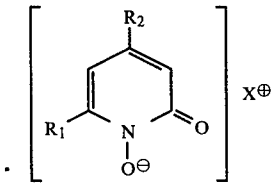

(wherein $R_1$ is an alkyl group having a carbon number of 1 to 17, alkenyl group having a carbon number of 2 to 17, cycloalkyl group having a carbon number of 5 to 8, bicycloalkyl group having a carbon number of 7 to 9, cycloalkyl-alkyl group having a carbon number of 1 to 4 in the alkyl portion (the cycloalkyl residue being optionally substituted by at least one alkyl group having a carbon number of 1 to 4); $R_2$ is hydrogen, alkyl group having a carbon number of 1 to 4, alkenyl group having a carbon number of 2 to 4, alkinyl group having a carbon number of 2 to 4, or halogen; and X is an organic amine residue.)

in an amount of 0.1 to 10.0% by weight of the composition weight.

3 Claims, No Drawings

α-OLEFIN SULFONATE-CONTAINING, LIQUID DETERGENT COMPOSITIONS HAVING IMPROVED LOW-TEMPERATURE STABILITY

BACKGROUND OF THE INVENTION

This invention relates to a liquid detergent composition, and more particularly to improvement on a liquid detergent composition containing α-olefin sulfonate as the main component.

To date, various anionic surface active agents and nonionic surface active agents have been applied as the main components of liquid detergent compositions for clothing, dwelling, tableware, hair, etc. Of these, anionic surface active agents in the form of a sodium salt or an ethanolamine salt have frequently been employed. Among the anionic surface active agents, an α-olefin sulfonate possesses high foaming ability and detergency. The α-olefin sulfonate, however, has a drawback, unlike an alkyl ethoxy sulfate and the like, in that it causes white turbidity at low temperatures because it has inferior stability at low temperatures. For this reason, application of the α-olefin sulfonate to liquid detergents has been difficult because of its poor commercial value, although the α-olefin sulfonate possesses superior performance.

Generally, an α-olefin sulfonate is a mixture containing a hydroxyalkane monosulfonate, an alkene monosulfonate and a small amount of an alkene disulfonate. Each of these components further contains several types of structural isomers. The mixture is recognized as an "α-olefin sulfonate" in the detergent industry. Since each of the components of the α-olefin sulfonate has a different crystallization point, the α-olefin sulfonate causes white turbidity where the component having the highest crystallization point is first allowed to precipitate as crystals at low temperatures. Once it causes white turbidity, the α-olefin sulfonate is unlikely to be easily returned again to a transparent state.

In order to improve the stability of the α-olefin sulfonate at low temperatures, it may be considered that a known hydrotrope (a compound possessing the ability to increase the water-solubility of an organic compound) such as ethanol, propylene glycol, glycerin or the like be added. In this case, the effect of depressing the freezing point of water can be recognized. However, not only the effect of improving the stability at low temperatures of the α-olefin sulfonate can be little improved, but the free water in the α-olefin sulfonate is decreased, thereby causing an increase in the amount of crystals precipitated at low temperatures.

As examples of employing an α-olefin sulfonate demonstrating such defects as hereinabove mentioned as a liquid detergent, British Pat. No. 1,225,218 illustrates examples obtained by adding alkali metal salts, ammonium salts or organic base salts of an alkyl- or alkenyl polyglycol ether carboxylic acid to an α-olefin sulfonate having 8 to 20 carbon atoms; and U.S. Pat. No. 3,852,221 illustrates examples prepared by adding a substituted fatty acid amido component and a sulfonated hydrotrope component and the like to an α-olefin sulfonate. In the detergents illustrated in these publications, however, the stabilities at low temperatures of the α-olefin sulfonates are not improved to a sufficient extent.

Accordingly, it has become important to produce liquid detergent compositions that have good stability at low temperatures; for example, at −5° C. or lower in winter in accordance with storage conditions.

SUMMARY OF THE INVENTION

The object of the present invention is to provide a liquid detergent composition possessing superior stability at low temperatures.

In accordance with the present invention, there is provided a liquid detergent composition containing:

(a) an anionic surface active agent represented by the general formula:

OS—M (wherein OS is an acid residue of a straight-chained olefin sulfonate having an average carbon number of 10 to 16, and M is an alkali- or alkaline earth metal)

in an amount of 3 to 30% by weight of the composition weight; and (b) a compound represented by the general formula:

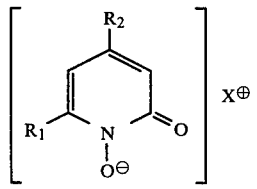

(wherein $R_1$ is an alkyl group having a carbon number of 1 to 17, alkenyl group having a carbon number of 2 to 17, cycloalkyl group having a carbon number of 5 to 8, bicycloalkyl group having a carbon number of 7 to 9, cycloalkyl-alkyl group having a carbon number of 1 to 4 in the alkyl portion (the cycloalkyl residue being optionally substituted by at least one alkyl group having a carbon number of 1 to 4); $R_2$ is hydrogen, alkyl group having a carbon number of 1 to 4, alkenyl group having a carbon number of 2 to 4, alkinyl group having a carbon number of 2 to 4, or halogen; and X is an organic amine residue.)

in an amount of 0.1 to 10.0% by weight of the composition weight.

DETAILED DESCRIPTION OF THE PREFERRED EMBODIMENTS

The liquid detergent composition in accordance with the present invention contains at least two essential components.

The first essential component of the liquid detergent composition in accordance with the present invention is an anionic surface active agent represented by the general formula:

OS—M (wherein OS is an acid residue of a straight-chained olefin sulfonate having an average carbon number of 10 to 16, and M is an alkali- or alkaline earth metal).

The first essential component is a substance generally called an "α-olefin sulfonate." The α-olefin sulfonate may be prepared by forming a thin film of α-olefin having a average carbon number of 10 to 16 and obtainable, for example, by the wax cracking process or the ethylene polymerization process using a Ziegler catalyst; converting the α-olefin into the corresponding sulfonate with a gaseous sulfuric acid anhydride diluted with an inert gas; neutralizing the sulfonate with an alkali metal salt or an alkaline earth metal salt, such as sodium hydroxide; and subjecting the product to hydrolysis. The product thus prepared is a mixture containing 10 to 45% by weight of HOS (Hydroxyalkane Sulfonate) (provided that the HOS comprises a dimer contained in an amount of 0.5 to 8% by weight, usually 1 to 5% by weight, and a polymer including a trimer and other polymers contained in an amount of 5 to 44.5% by weight); 55 to 80% by weight of ANS (Alkenyl Sulfonate); and 3 to 15% by weight of DS (Alkenyl Disulfonate).

The amount of anionic surface active agent mentioned hereinabove ranges from 3 to 30% by weight and, preferably, from 7 to 20% by weight of the weight of the liquid detergent composition.

The second essential component of the liquid detergent composition in accordance with the present invention is pyridone salt represented by the general formula:

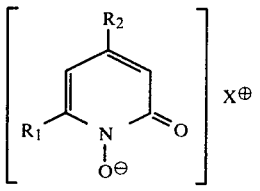

(wherein $R_1$ is an alkyl group having a carbon number of 1 to 17, alkenyl group having a carbon number of 2 to 17, cycloalkyl group having a carbon number of 5 to 8, bicycloalkyl group having a carbon number of 7 to 9, cycloalkyl-alkyl group having a carbon number of 1 to 4 in the alkyl portion (the cycloalkyl residue being optionally substituted by at least one alkyl group having a carbon number of 1 to 4); $R_2$ is hydrogen, alkyl group having a carbon number of 1 to 4, alkenyl group having a carbon number of 2 to 4, alkinyl group having a carbon number of 2 to 4, or halogen; and X is an organic amine residue.)

The above-mentioned pyridone salts concretely include the organic amine salts of the undermentioned compounds:

1-hydroxy-2-pyridone
1-hydroxy-4-methyl-2-pyridone
1-hydroxy-4, 6-dimethyl-2-pyridone
1-hydroxy-4-methyl-6-heptyl-2-pyridone
1-hydroxy-4-methyl-6-(1-ethyl-pentyl)-2-pyridone
1-hydroxy-4-methyl-6-(2, 4, 4, -trimethyl-pentyl)-2-pyridone
1-hydroxy-4-methyl-undecyl-2-pyridone
1-hydroxy-4-methyl-6-propenyl-2-pyridone
1-hydroxy-4-methyl-6-octenyl-2-pyridone
1-hydroxy-4-methyl-6-(2, 2-dibutyl-vinyl)-2-pyridone
1-hydroxy-4-methyl-6-(cyclohexenylidene-methyl)-2-pyridone
1-hydroxy-4-methyl-6-cyclohexyl-2-pyridone
1-hydroxy-4-methyl-6-(methyl-cyclohexyl)-2-pyridone
1-hydroxy-4-methyl-6-(2-bicyclo[2, 2, 1]heptyl-2-pyridone
1-hydroxy-4-methyl-6-[2-(dimethylcyclohexyl)-propyl]-2-pyridone The amines forming the amine salts of the previously listed pyridones include the following:

ethanolamine, diethanolamine, N-ethyl-ethanolamine, N-methyl-diethanolamine, triethanolamine, diethylaminoethanol, 2-amino-2-methyl-n-propanol, dimethylaminopropanol, 2-amino-2-methyl-propane-diol, triisopropanolamine, ethylenediamine, hexamethylenediamine, morpholine, piperidine, cyclohexylamine, tributylamine, dodecylamine, N, N-dimethyldodecylamine, stearylamine, oleylamine, benzylamine, dibenzylamine, N-ethyl-benzylamine, dimethyl-stearylamine, N-methyl-morpholine, N-methyl-piperazine, 4-methylcyclohexylamine, N-hydroxy-ethyl-morpholine.

The proportions of the aforementioned salts are chosen to range from 0.1 to 10.0% by weight or preferably from 0.1 to 5.0% by weight of a liquid detergent composition. Where the proportion falls from 0.1% by weight, then the low-temperature stability of a liquid detergent composition is not improved. Conversely where the proportion rises above 10.0% by weight, then a decline arises in the solubility of the pyridone salt itself in a liquid detergent composition.

The above described liquid detergent composition embodying this invention indicates a satisfactory low-temperature stability even without applying an organic solvent such as ethanol, ethylene glycol, propylene glycol or polyethylene glycol, hydrotrope such as sodium benzene sulfonate, sodium paratoluene sulfonate or sodium xylene sulfonate, or a low-temperature stabilizing agent such as urea.

The liquid detergent composition of the invention is prepared as a marketable solution by dissolving the various components in water. If necessary, it is possible to apply an additive customarily used with a known liquid detergent or shampoo to the liquid detergent composition of the invention. Said additive includes an anion surface active agent such as alcohol-ethoxy sulfate containing ethylene oxide having an average mol number of 1.0 to 5.0; anion surface active agent such as alcohol sulfate or amine laurate; nonionic surface active agent such as coconut fatty acid diethanol amide or ethylene oxide addition product of higher alcohol; milk casein; gelatin; protein hydrosis product; and acylated protein.

The items of the generally accepted comparative test are as follows:

1. Foamability

The process used comprises sampling 20 mol of a 6% aqueous solution (25° C.) of a sample of liquid detergent composition into a measuring cylinder having a capacity of 100 ml. 0.2 g of liquid lanorin is added to said sampled solution as an artificial filth. The solution is shaken 20 times during 10 seconds for foaming. The foamed solution is allowed to stand for 1 minute. Thereafter the total volume (ml) of all foams is determined.

2. Low-temperature stability

A sample was stored for one month at a temperature of −5° C. Naked eye determination was made of the presence of white turbidity, that is, precipitated crystals in the sample maintained at said temperature. Where the sample composition indicated no white turbidity, then said condition was marked with a notation "O". Conversely where any white turbidity was found in the sample composition, then said condition was marked with a notation of "X".

3. Kraft point

A 10% aqueous solution of a sample is allowed to stand at a temperature of −10° C. for 5 hours. After frozen, the solution is progressively heated at a temperature increment of 1° C./10 min. Determination is made of a temperature at which the sample becomes uniformly transparent.

Test 1

Various compounds were blended with α-olefin sulfonate, the first requisite component of a liquid detergent composition embodying this invention. The properties of the sample liquid detergent composition were tested, the results being set forth in Table 1 below.

TABLE 1

| Blended component | Control 1 | 2 | 3 | 4 | 5 | 6 | 7 | Example 1 | Example 2 | 8 |
|---|---|---|---|---|---|---|---|---|---|---|
| AOS-Na[1] | 15 | 15 | 15 | 15 | 15 | 15 | 15 | 15 | 15 | 15 |
| Compound (A)[2] | | | | | | | | 2 | 2 | |
| BHT[3] | | 2 | | | | | | | | |
| BHA[4] | | | 2 | | | | | | | |
| α-tocopherol | | | | 2 | | | | | | |
| EDTA-2Na[5] | | | | | 2 | | | | | |
| Propylene glycol | | | | | | 2 | | | | |
| Glycerin | | | | | | | 2 | | | |
| Ethanol | 3 | 3 | 3 | 3 | 3 | 3 | 3 | 3 | | |
| Monoethanol amine | | | | | | | | | | 2 |
| Water | remainder | " | " | " | " | " | " | " | " | " |
| Foamability (ml) | 55 | 55 | 55 | 55 | 55 | 55 | 55 | 55 | 55 | 55 |
| Low-temperature stability | x | x | x | x | x | x | x | o | o | x |
| Kraft point (°C.) | 15 | 15 | 15 | 15 | 15 | 15 | 15 | below zero | below zero | 15 |

Notes:
[1]AOS-Na = sodium α-olefin sulfonate having 14 carbon atoms (molecular weight: 308)
[2]Compound (A) = the aforementioned 1-hydroxy-4-methyl-6-(2, 4, 4-trimethylpentyl)-2-(1-hydro)-pyridone monoethanol amine salt
[3]BHT = dibutyl hydroxytoluene
[4]BHA = butyl hydroxyanisol
[5]EDTA - 2Na = ethylene diamine tetraacetate-2 sodium Table 1 above shows that any other liquid detergent than the liquid detergent of this invention prepared by blending a second requisite component with the first requisite component of α-olefin sulfonate has less satisfactory low-temperature stability and kraft point characteristic. In Control 8, monoethanol amine (counterpart ion of the compound (A)) is blended with α-olefin sulfonate. But blending of this additive is found to offer no effect.

Test 2

Tests were made of the properties of the samples prepared by blending the first and second requisite components of the liquid detergent composition of this invention in different proportions, samples mixed with different additives, and samples in which the second requisite component was replaced by other compounds having a structural formula similar to that of said second requisite component. The results of the tests are sent forth in Table 2 below.

TABLE 2

| Blended component | Control 9 | Example 3 | 4 | 5 | 6 | 7 | 8 | 9 | 10 | 10 |
|---|---|---|---|---|---|---|---|---|---|---|
| AOS-Na[9] | 15 | 15 | 15 | 20 | 30 | 10 | 10 | 10 | 10 | 15 |
| Compound (A)[2] | 0.01 | 0.1 | 5 | 5 | 10 | 2 | 2 | 2 | 2 | |
| LES-Na[6] | | | | | | 5 | | | | |
| AS-TEA[7] | | | | | | | | 5 | | |
| Coconut oil fatty acid diethanol amide | | | | | | | | | 5 | |
| Compound (B)[8] | | | | | | | | | | 5 |
| Water | remainder | " | " | " | " | " | " | " | " | " |
| Foamability (ml) | 55 | 55 | 55 | 70 | 80 | 45 | 50 | 50 | 50 | 55 |
| Low-temperature stability | x | o | o | o | o | o | o | o | o | o |
| Kraft point(°C.) | 15 | below zero | " | " | " | " | " | " | " | 10 |

Notes:
[6]LES-Na = sodium alkyl ether sulfate (alkyl radical: $C_{12}/C_{13}$ = 1/1; EO = 3 mol)
[7]AS-TEA = lauryl sulfate triethanol amine salt
[8]1 hydroxy-4-methyl-6-(3-methylphenoxy-methyl)-2-pyridone monethanol amine salt
[9]AOS-Na = sodium α-olefin sulfonate having 14 to 16 carbon atoms Table 2 above shows that liquid detergent compositions falling within the scope of this invention all have a prominent liquid stability. Control 10 proves that any other compound than the second requisite component of this invention is not effective to assure the liquid stability of the resultant liquid detergent, even through having a structural formula similar to that of the compound (A).

What we claim is:

1. A liquid detergent composition containing:

(a) an anionic surface active agent represented by the general formula:

OS—M (wherein OS is an acid residue of a straight-chained olefin sulfonate having an average carbon number of 10 to 16, and M is an alkali- or alkaline earth metal)

in an amount of 3 to 30% by weight of the composition weight; and (b) a pyridone salt represented by the general formula:

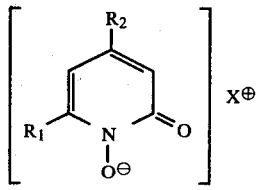

(wherein $R_1$ is an alkyl group having a carbon number of 1 to 17, alkenyl group having a carbon number of 2 to 17, cycloalkyl group having a carbon number of 5 to 8, bicycloalkyl group having a carbon number of 7 to 9, cycloalkyl-alkyl group having a carbon number of 1 to 4 in the alkyl portion or cycloalkyl-alkyl wherein said cycloalkyl residue is substituted by at least one alkyl group having a carbon number of 1 to 4; $R_2$ is hydrogen, alkyl group having a carbon number of 1 to 4, alkenyl group having a carbon number of 2 to 4, alkinyl group having a carbon number of 2 to 4, or halogen; and X is an organic amine residue)

in an amount of 0.1 to 10.0% by weight of the composition weight.

2. A liquid detergent composition according to claim 1, wherein the amount of said anionic surface active agent is 7 to 20% by weight, and the amount of said pyridone salts is 0.1 to 5.0% by weight.

3. A liquid detergent composition according to claim 1 or 2, further containing water as a solvent.

* * * * *